US006053020A

United States Patent [19]

Tiepelmann et al.

[11] Patent Number: 6,053,020

[45] Date of Patent: Apr. 25, 2000

[54] DEVICE AND METHOD FOR RAPID ROLL CHANGES IN A SIX-HIGH ROLL STAND

[75] Inventors: Bernd Tiepelmann; Dieter Daub, both of Hilchenbach; Dieter Dickel, Erndtebrück, all of Germany

[73] Assignee: SMS Schloemann-Siemag Aktiengesellschaft, Düsselfdorf, Germany

[21] Appl. No.: 09/177,298

[22] Filed: Oct. 22, 1998

[30] Foreign Application Priority Data

Oct. 24, 1997 [DE] Germany ..... 197 47 013

[51] Int. Cl.[7] ..... B21B 31/07; B21B 31/08

[52] U.S. Cl. ..... 72/239

[58] Field of Search ..... 72/237, 238, 239

[56] References Cited

U.S. PATENT DOCUMENTS 4,435,970 3/1984 Sekiya ..... 72/239

FOREIGN PATENT DOCUMENTS 3244-200 5/1984 Germany ..... 72/238

55-13807 10/1980 Japan ..... 72/239

*Primary Examiner*—Rodney Butler

*Attorney, Agent, or Firm*—Friedrich Kueffner

[57] ABSTRACT

A device and a method for rapid roll changes in a six-high roll stand, wherein the device includes a roll change carriage with a unit for moving the carriage relative to the roll stand parallel to and transversely of the rolling direction, and two retaining components for a pair of work rolls and a pair of intermediate rolls, wherein the retaining components are arranged next to each other and form a side-shifter cassette, wherein the retaining components have guide surfaces for the chocks of the rolls, and wherein the change carriage has in the common rolling plane a device for pushing the rolls in and out. Each retaining component has for receiving a lower intermediate roll with the chocks thereof an intermediate frame with a unit for moving the intermediate frame into and out of the side-shifter cassette.

9 Claims, 12 Drawing Sheets

12
X
10
11
22
20
21
23
3
40
4
5
X

DEVICE AND METHOD FOR RAPID ROLL CHANGES IN A SIX-HIGH ROLL STAND

BACKGROUND OF THE INVENTION

1. Field of the Invention

The present invention relates to a device and a method for rapid roll changes in a six-high roll stand. The device includes a roll change carriage with means for moving the carriage relative to the roll stand parallel to and transversely of the rolling direction, and two retaining components for a pair of work rolls and a pair of intermediate rolls, wherein the retaining components are arranged next to each other and form a side-shifter cassette, wherein the retaining components have guide surfaces for the chocks of the rolls, and wherein the change carriage has in the common rolling plane a device for pushing the rolls in and out.

2. Description of the Related Art

A roll change device for a six-high roll stand having the above-described configuration is disclosed in BR-A-PI 7602387. In this device, the individual rolls together with their chocks are placed by means of a crane in a certain sequence in one of two retaining components arranged next to one another, wherein the rolls are placed in the retaining components in dependence on the next roll change to be carried out. This device has the disadvantage that it is not possible to carry out an exchange of only the set of intermediate rolls. In addition, the known device can only be used if the chocks of the intermediate rolls have smaller dimensions than the chocks of the work rolls.

DE-A-31 23 933 discloses a roll change device for six-high roll stands which has the advantage that the dimensions of the chocks of the set of intermediate rolls does not have to be smaller than the dimensions of the chocks of the set of work rolls. However, this known device also has the disadvantage that complicated and time-consuming reconfiguration and regrouping operations have to be carried out if, instead of the intended change of work rolls, a simultaneous change of the set of intermediate rolls is required. In the known device, it is not possible to carry out only an exchange of the intermediate rolls if that is necessary.

EP 0 112 981 A2 describes a roll change device for six-high roll stands which makes possible either the exchange of the set of work rolls alone or an exchange of the set of work rolls together with the set of intermediate rolls. However, if necessary, it should also be possible to exchange only the set of intermediate rolls. For that purpose, a roll change carriage and a roll loading station are provided. The roll loading station has two retaining departments, wherein one department is capable of receiving only a set of intermediate rolls and the other compartment is capable of only receiving a set of work rolls. This device has the disadvantage that the retaining components of the roll change carriage are constructed so as to be closed toward the top and are only opened at end faces which are located opposite each other. Consequently, it is not possible to exchange all rolls directly by means of a crane out of the roll change carriage or the side-shifter.

SUMMARY OF THE INVENTION

Therefore, starting from the prior art discussed above, it is the primary object of the present invention to provide a device and a method for using the device in which it is possible to exchange all tolls directly by means of a crane out of the roll change carriage or the side-shifter, so that the roll change is significantly simplified without being bound to a predetermined roll change program.

In accordance with the present invention, in a device of the above-described type, each retaining component has for receiving a lower intermediate roll with the chocks thereof an intermediate frame with means for moving the intermediate frame into and out of the side-shifter cassette.

The configuration according to the present invention makes it possible that when the intermediate frame is moved out all rolls can be lifted directly by means of a crane into or out of the roll change frame or the side-shifter.

This configuration of the device also makes it possible, for example, that the arrangement of an auxiliary frame with guide rails in front of the roll change carriage can be omitted, and, due to the structural changes at the side-shifter cassette resulting from the arrangement of the intermediate frame with means for moving the intermediate frame in and out of the side-shifter cassette, a significant simplification of the individual work steps is achieved as compared to the conventional sequence.

In accordance with a further development of the device according to the present invention, the roll change carriage has an undercarriage for moving the roll change carriage transversely of the rolling direction on rails placed on the ground, wherein the undercarriage supports rails extending in the rolling direction, wherein the rails extending in the rolling direction support the side-shifter cassette which is movable independently of the undercarriage.

In accordance with another development of the present invention, the side-shifter cassette is provided with a tong truck as the means for moving the rolls into and out of the roll stand or to and from the shop, wherein the tong truck is movable by means of a rack drive through a retaining component each of the side-shifter cassette.

Another important development of the present invention provides that the device includes preferably hydraulically actuated locking means, namely

- locking means for locking the roll change carriage to the roll stand;
- locking means for locking the roll change carriage to the tong truck;
- locking leans for locking each intermediate frame independently to the undercarriage; and
- locking means for locking both intermediate frames to the side-shifter.

In accordance with a particularly useful embodiment of the tong truck, the tong truck is composed of three parts, namely,

- an upper part with the upper intermediate roll;
- a middle part with the two work rolls; and
- a lower part with the lower intermediate roll,
- wherein the three parts are configured to interact with each other.

Docking systems are provided between the middle part and the upper part, on the one hand, and between the middle part and the lower part, on the other hand.

In addition, for exchanging the upper and lower intermediate rolls, the upper part and the lower part can be coupled to the middle part.

The supply with hydraulic oil is ensured by hydraulic docking systems. For this purpose, the tong truck advantageously has on one side thereof hydraulic docking elements which are provided with connecting elements to connect two hydraulic energy sources, for example, for supplying the upper and lower tong manipulators.

The middle part of the tong truck can also be connected by means of a trailing cable chain to a stationary hydraulic supply unit. The additional operating units of the tong truck, which are required, for example, for the exchange of the intermediate rolls, can be coupled by locking means to the moving part of the roll change carriage and are preferably supplied with hydraulic energy through a docking system at the end faces.

In this manner, it is especially not necessary to provide independent energy units for the upper and lower parts of the tong truck, so that the tong truck can be of relatively uncomplicated construction and may be composed of two or more operational units for separately moving the work rolls and/or intermediate rolls in and out.

On the other hand, the roll change carriage has two docking systems for conrecting elements at the stand as well as in the roll shop.

Finally, in accordance with a further development of the undercarriage according to the present invention, the undercarriage is provided with auxiliary frames for receiving the lower intermediate rolls next to the side-shifter.

A method for carrying out a rapid roll change cycle in a six-high roll stand using the device according to the present invention includes the following work step:

a) preparing the stand for the roll change;

b) moving the roll change carriage laterally next to the stand with an empty retaining component of the side-shifter in the position of the middle plane of the stand, and moving the other retaining component filled with "new" rolls into a laterally offset position;

c) moving the tong truck through the empty retaining component and grasping as well as pulling the "old" work rolls and/or intermediate rolls to be exchanged out of the stand into the retaining component;

d) moving the tong truck back out of the side-shifter;

e) moving the side-shifter in the rolling direction with a set of "new" work rolls and/or intermediate rolls into a position in the middle plane of the stand;

f) pushing the "new" rolls into the stand by means of the tong truck;

g) moving :he tong truck back out of the side-shifter;

h) uncoupling the intermediate frame with the "old" intermediate roll and locking the intermediate frame to the undercarriage, moving the side-shifter to the side with the rest of the rolls into the position in the middle of the stand;

i) moving the upper intermediate roll, the upper work roll, the lower work roll out of the side-shifter, and the lower intermediate roll out of the intermediate frame by means of a crane;

j) moving the side-shifter without the undercarriage locked to the intermediate frame but with the right retaining component into the stand riddle position and loading the side-shifter with the lower work roll, the upper work roll and the upper intermediate roll, and loading the right intermediate frame with the lower intermediate roll; and k) moving he side-shifter over the full intermediate frame with the empty retaining component into the position of the middle plane of the stand for preparing for repeating the cycle according to work steps a) through g).

The possibility of exchanging all rolls directly by means of a crane out of the side-shifter not only constitutes a significant simplification of the roll exchange, but additionally makes it possible, independently of each other as well as independently of given roll exchange programs, to exchange either only one set of work rolls or additionally the sets of work rolls and the sets of intermediate rolls in any chosen sequence.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
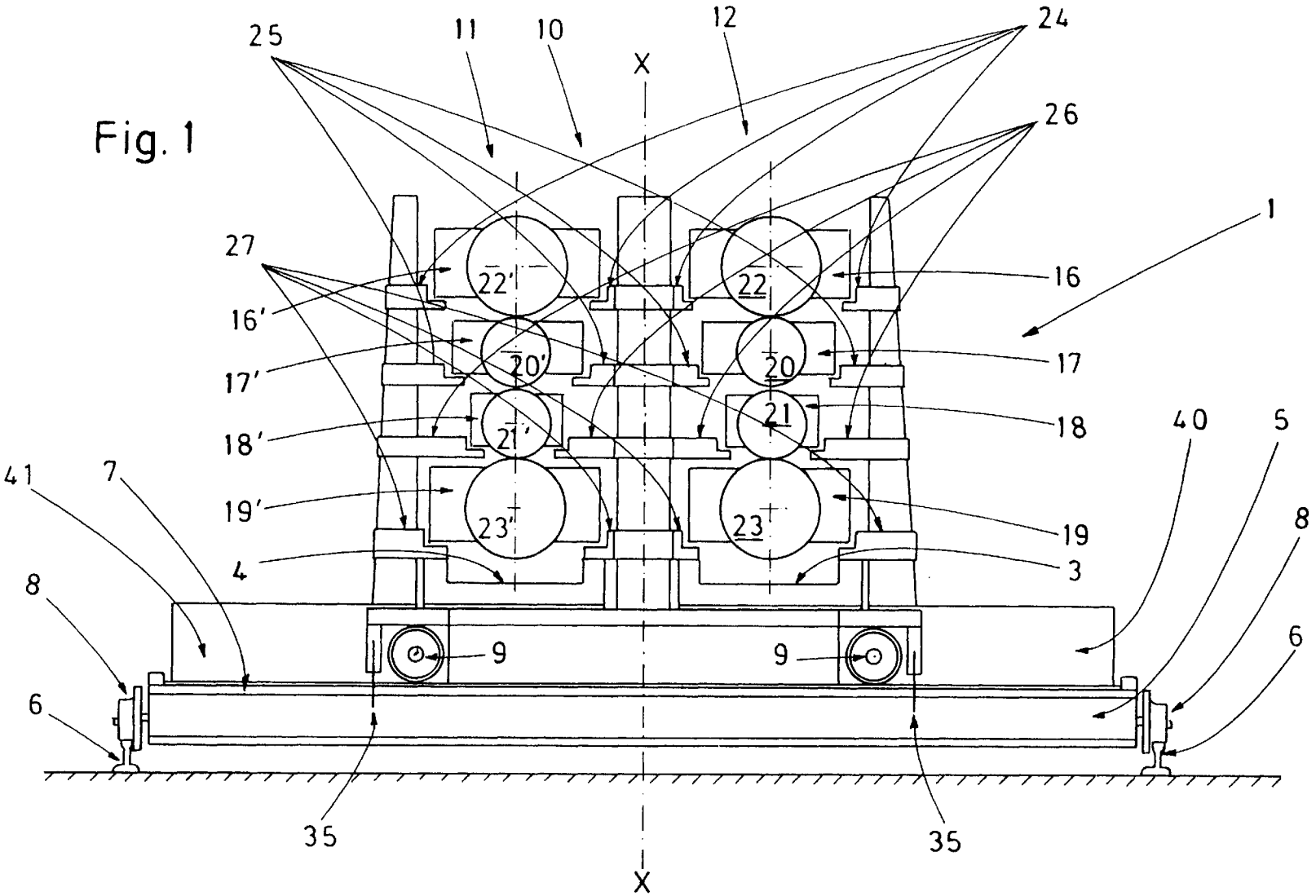
FIG. 1 is a side view of a roll change carriage with a sideshifter cassette seen in the direction from the roll stand.

The roll change carriage 1 schematically illustrated in FIG. 1 includes an undercarriage 5 with motor-driven wheels 8 for moving the roll change carriage 1 on rails 6 placed on the ground transversely of the rolling direction. The undercarriage 5 has rails 7 extending in the rolling direction for moving the side-shifter with wheels 9 and drives, not shown, in the rolling direction.

The side-shifter 10 is composed of two retaining components 11, 12 for a pair each of work rolls and intermediate rolls 20–23, 20'–23', wherein the retaining components are arranged next to one another to form the side-shifter cassette. The retaining components 11, 12 are provided with guide surfaces 24–27 for the chocks 16–19 or 16'–19' of the rolls, wherein the roll change carriage 1 is provided in the common rolling plane x—x with a device 2 in the form of a tong truck illustrated in FIG. 2 for moving the rolls in and out.

In accordance with the invention, each retaining component 11, 12 has for receiving a lower intermediate roll 23, 23' with its chocks 19, 19' an intermediate frame 3, 4 with means for moving it into and out of the side-shifter cassette 10. Moreover, in accordance with a significant development according to the present invention, the undercarriage 5 is provided with auxiliary frames 40, 41 for receiving the intermediate frames 3, 4 next to the side-shifter 10.

Figure 2:
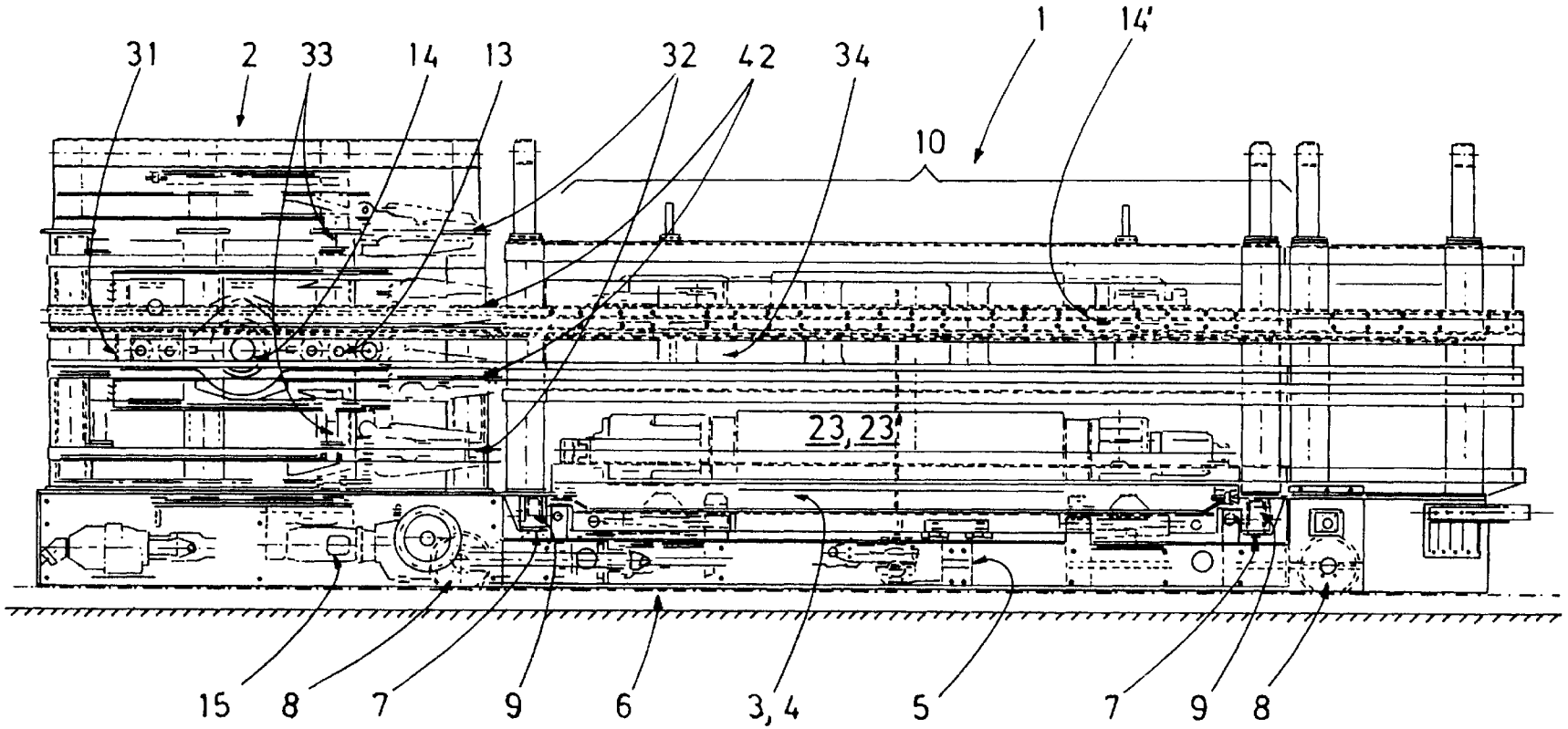
FIG. 2 is a side view of the roll change carriage with sideshifter and tong truck coupled thereto.

FIG. 2 shows in a side view the roll change carriage 1 with undercarriage 5 and its wheels 8 with drive units 15 travelling on rails 6 placed on the ground. By means of the rails 7 placed on the undercarriage 5, the undercarriage 5 supports the intermediate frame 3, 4 of the side-shifter cassette 10 movable in the rolling direction on the wheels 9. Shown in dash-dot lines is an intermediate roll 23, 23' in the lateral position in the roll change carriage 1. As illustrated in FIG. 1, above the intermediate roll are located the two work rolls 21, 20 and thereabove the upper intermediate roll 22. For clarity's sake, these rolls are not shown in FIG. 2.

The tong truck 2 has tong manipulators 32 for upper and lower intermediate rolls and tong manipulators 42 for the work rolls as well as locking devices 33 for locking the tong truck 2 to the undercarriage 5. The locking devices are hydraulically actuated. In accordance with an important development of the invention, the tong truck 2 has on one side thereof connecting elements 31 which interact with a docking system for the supply with hydraulic energy. In accordance with a preferred feature, the tong truck 2 can also be connected through a trailing cable train to a stationary hydraulic energy supply system. The tong manipulators 32 and 42 are equipped with guide rollers 13 so as to be movable in a rail guide unit 34 through the retaining components 11, 12 of the side-shifter cassette 10.

The drive is effected by means of the motor 14 which interacts with the rack 14'. Counter-connecting elements, not shown, corresponding to the connecting elements 31 are provided in the shop, wherein the counter-connecting elements are provided with hydraulic energy sources and supply at least individual units of the tong truck 2, for example, the tong manipulators for the intermediate rolls 32, with hydraulic energy.

On the other hand, the roll change carriage 1 has two docking system with connections to the stand, on the one hand, and to the roll shop, on the other hand.

The roll change carriage 1 additionally has locking means for locking the carriage 1 to the roll stand, locking means 33 for locking the carriage 1 to the tong truck 2, locking means 35 for locking both intermediate frames 3, 4 independently to the undercarriage 5, as well as locking means for locking both intermediate frames 3, 4 independently of each other to the sideshifter 10. For clarity's sake, only some of the locking means are illustrated in FIGS. 1 and 2. For example, FIG. 1 schematically shows the locking means 35 for locking the two intermediate frames 3, 4 independently of each other to the undercarriage 5.

FIGS. 3–11 show the novel sequence of a cycle for the rapid exchange of rolls in a six-high roll stand using the device according to the present invention shown in FIGS. 1 and 2. The sequence includes the following work steps:

a) preparing the stand for the roll change;

b) moving the roll change carriage 1 laterally next to the stand with an Empty retaining component 11 of the side-shifter 10 in the position of the middle plane x—x of the stand, and moving the other retaining component 12 filled with "new" rolls 20–23 into a laterally offset position;

c) moving the tong truck 2 through the empty retaining 11 component and grasping as well as pulling the "old" work rolls and/or intermediate rolls 20'–23' to be exchanged out of the stand into the retaining component 11;

d) moving the tong truck 2 back out of the side-shifter 10;

e) moving the side-shifter 10 in the rolling direction with a set of "new" work rolls and/or intermediate rolls 20–23 into a position in the middle plane x–x of the stand;

f) pushing the "new" rolls into the stand by means of the tong truck 2;

g) moving the tong truck 2 back out of the side-shifter 10;

h) uncoupling the intermediate frame 3 with the "old" intermediate roll 23' and locking the intermediate frame to the undercarriage 5, moving the side-shifter 10 to the side with the rest of the rolls 20'–22' into the position in the middle of the stand;

i) moving the upper intermediate roll 22', the upper work roll 20', the lower work roll 21' out of the side-shifter 10, and moving the lower intermediate roll 23' out of the intermediate frame 3 by means of a crane;

j) moving the side-shifter 10 without the intermediate frames 3, 4 locked to the undercarriage 5 but with the right retaining component 12 into the stand middle position x—x and loading the side-shifter with the lower work roll 21, the upper work roll 20 and the upper intermediate roll 22, and loading the right intermediate frame 4 with the lower intermediate roll 23 by means of a crane; and k) moving the side-shifter 10 over the full intermediate frame 4 with the empty retaining component 11 into the position x—x of the middle plane of the stand for preparing for repeating the cycle according to work steps a) through g).

Figure 3:
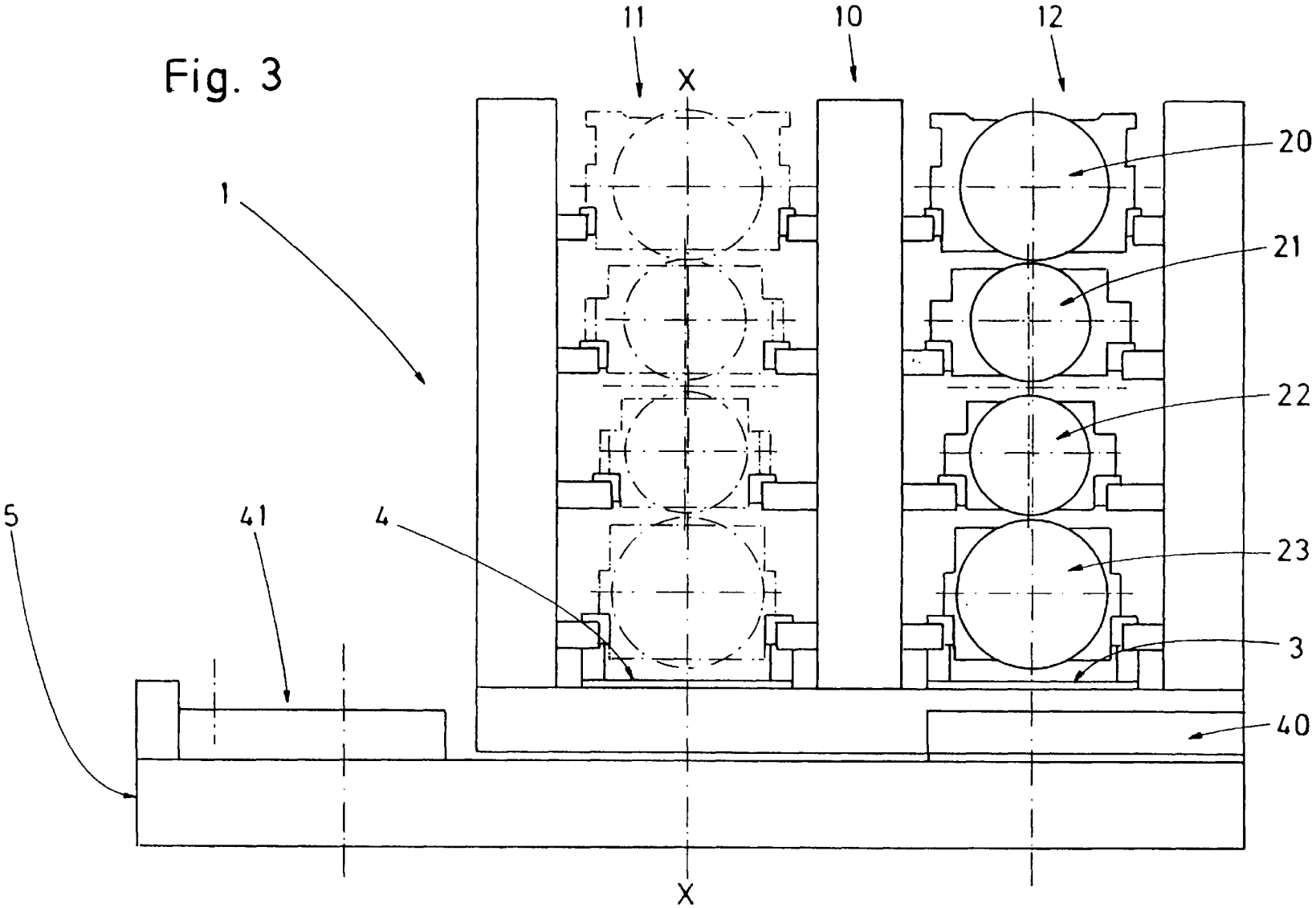
FIGS. 3–11 are illustrations of the device according to the present invention corresponding to FIG. 1, showing a sequence of work steps for carrying out a cycle of a rapid roll change in a six-high roll stand.

In this connection, FIG. 3 shows the roll change carriage 1 in the position in front of the stand with a new set of rolls 20–23 in the right retaining component 12 of the side-shifter 10. The left retaining component is located in the plane of the stand middle x–x ready, for receiving the rolls from the stand to be exchanged. In addition, FIG. 3 shows the undercarriage 5 with the auxiliary frames 40, 41 and the intermediate frames 3 and 4.

Figure 4:
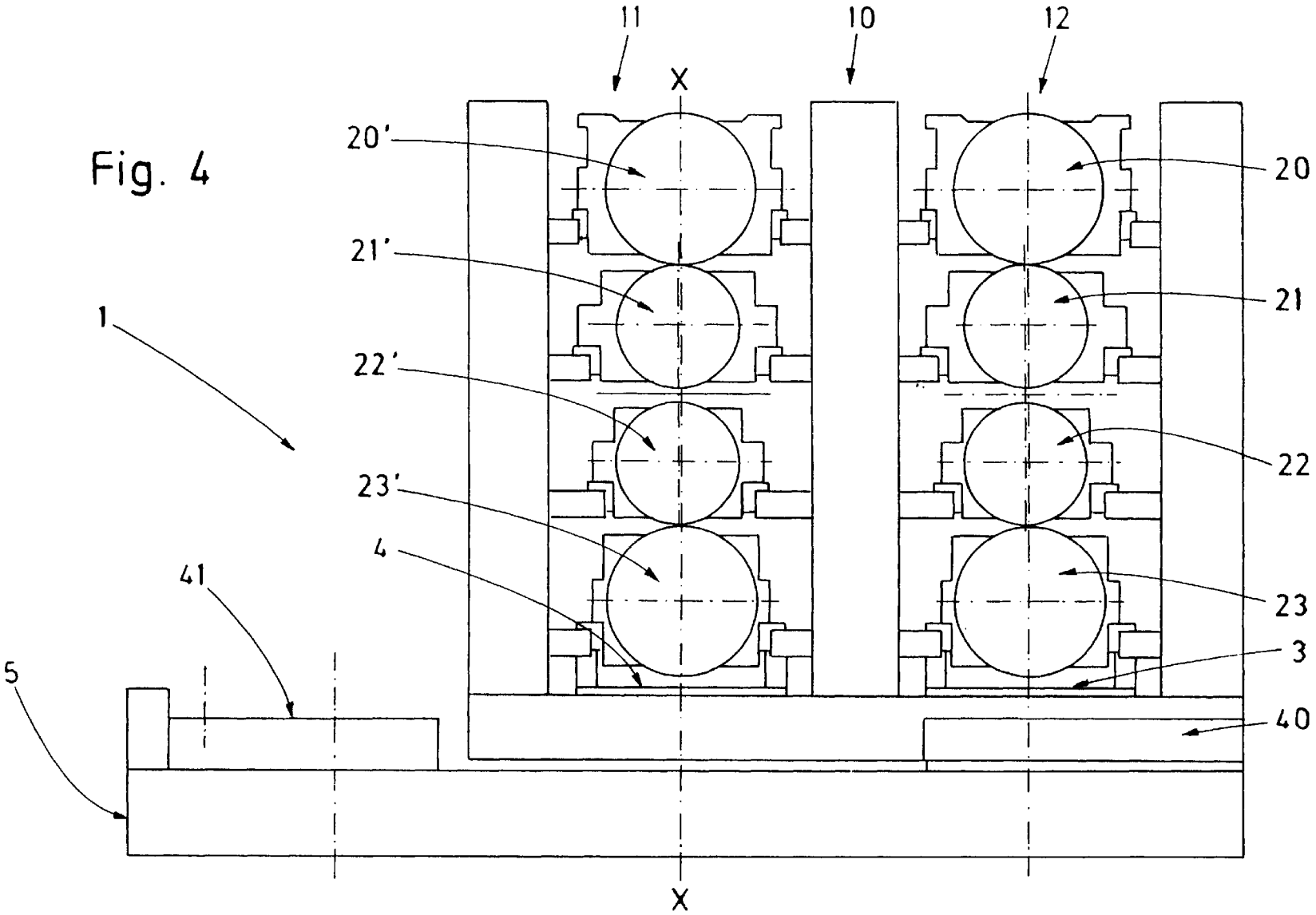

FIG. 4 shows the cycle phase in which the old rolls 20'–23' have been pulled out of the stand into the roll exchange carriage 1 or its side-shifter 10.

In FIG. 4, as well as in the additional FIGS. 5–11, equal elements are provided with the same reference numerals and, for clarity's sake, the reference numerals are not shown in all of the Figures.

Figure 5:
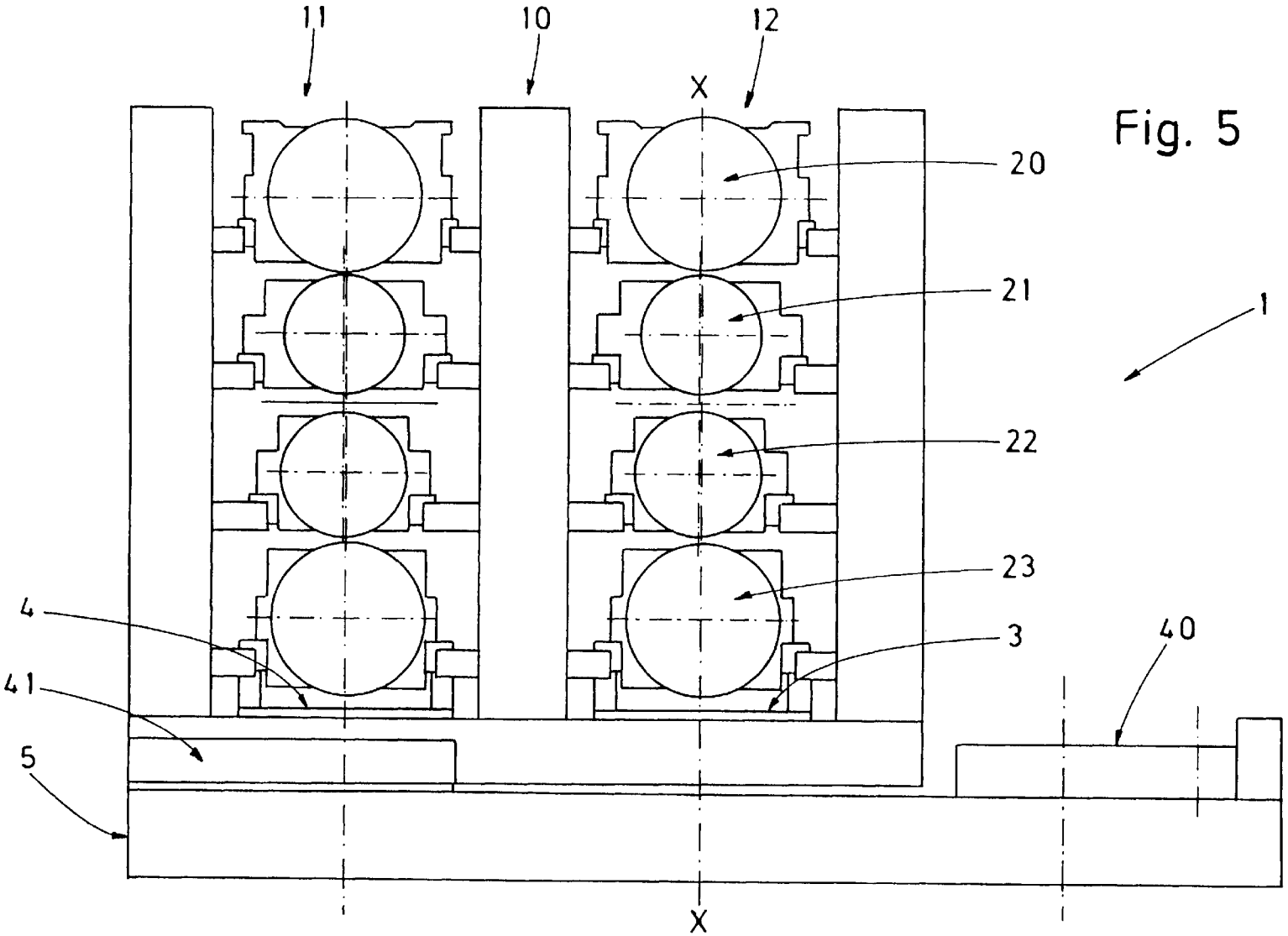

FIG. 5 shows another phase in which the side-shifter 10 has been moved transversely toward the left. The retaining component 12 is now in the middle plane x—x of the roll stand, so that the new set of roll 20–23 can be pushed completely into the roll stand.

Figure 6:
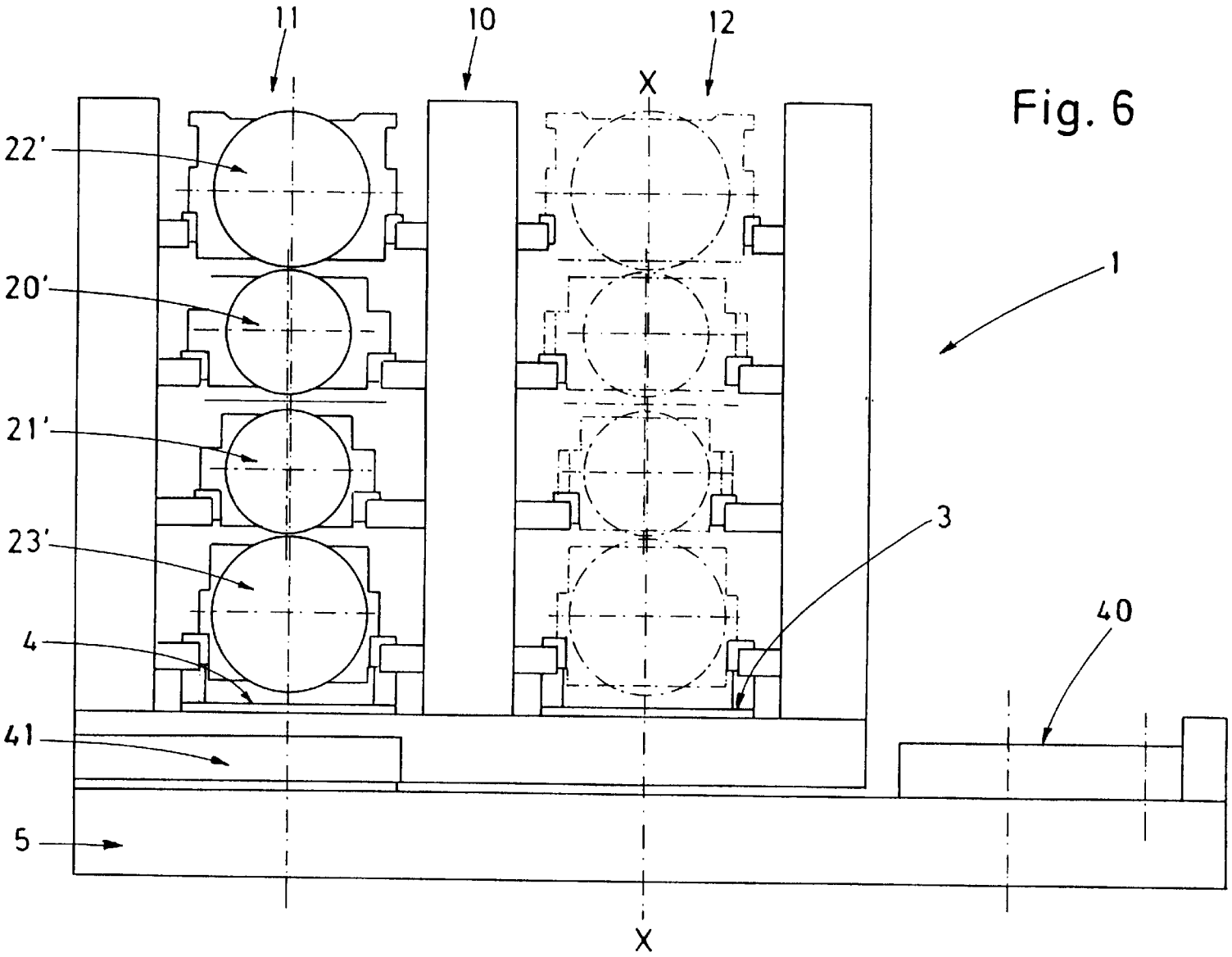
Figure 7:
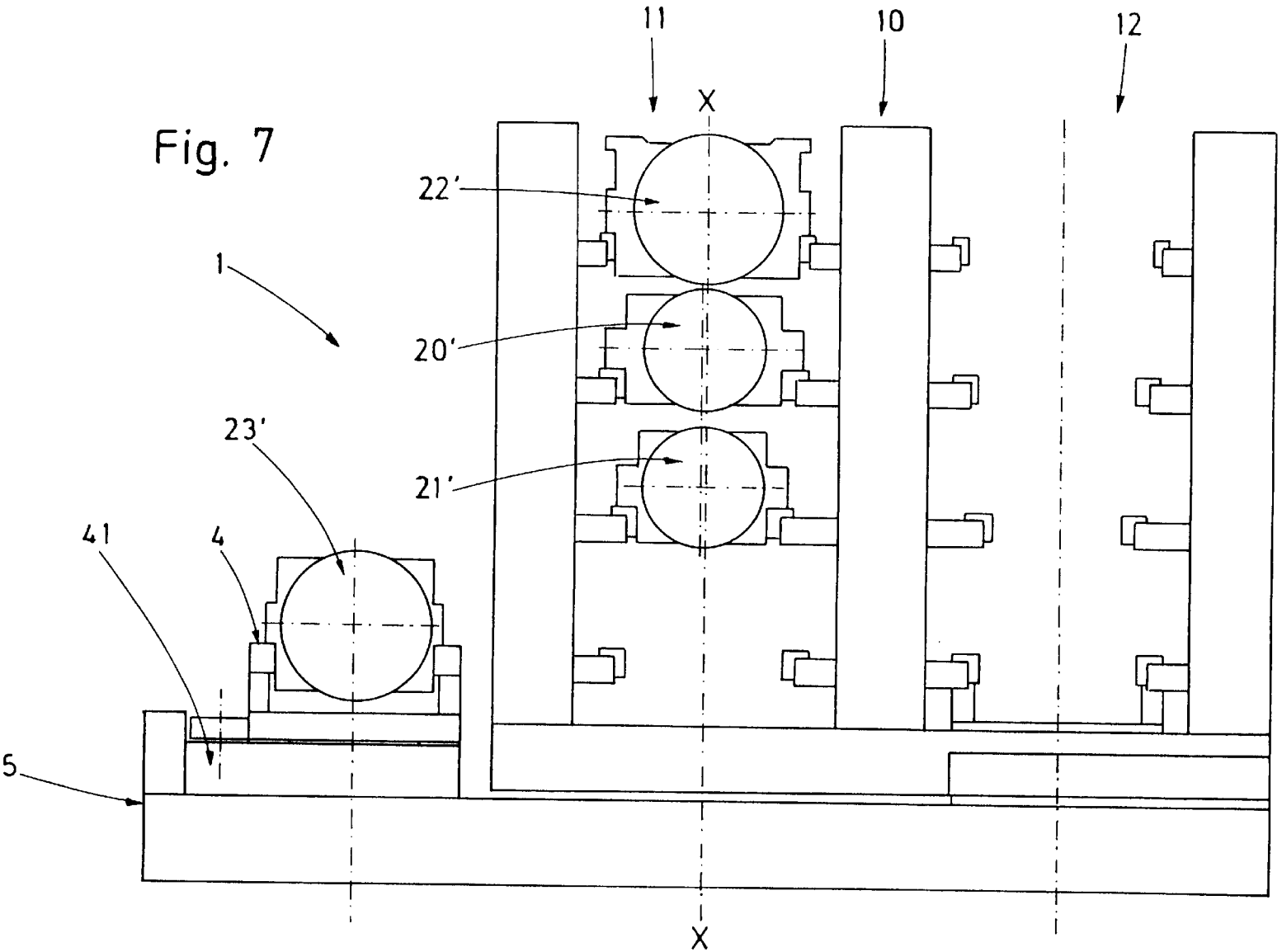

FIG. 6 shows the work phase with the emptied right retaining component 12, wherein the retaining component 11 still contains the used set of rolls 20'–23'. As shown in FIG. 7, the side-shifter 10 is now pushed toward the right without the intermediate frame 4 which still supports the lower intermediate roll 23', so that the retaining component 11 has now reached the position in the middle x—x of the roll stand. The retaining component 11 now only contains the old rolls, i.e., the upper intermediate roll 22' and the set of old work rolls 20', 21'.

Since the chocks 16', 17', 18' are offset in relation to the guide surfaces 24, 25, 26 in such a way that the rolls 22', 20', 21' can be eacily lifted toward the top by means of the crane, as is apparent from FIG. 1, the rolls are now taken out without problems in the next work step. The old lower intermediate roll 23' which has been moved laterally outwardly can now also be moved out by means of the crane and removed.

Figure 8:
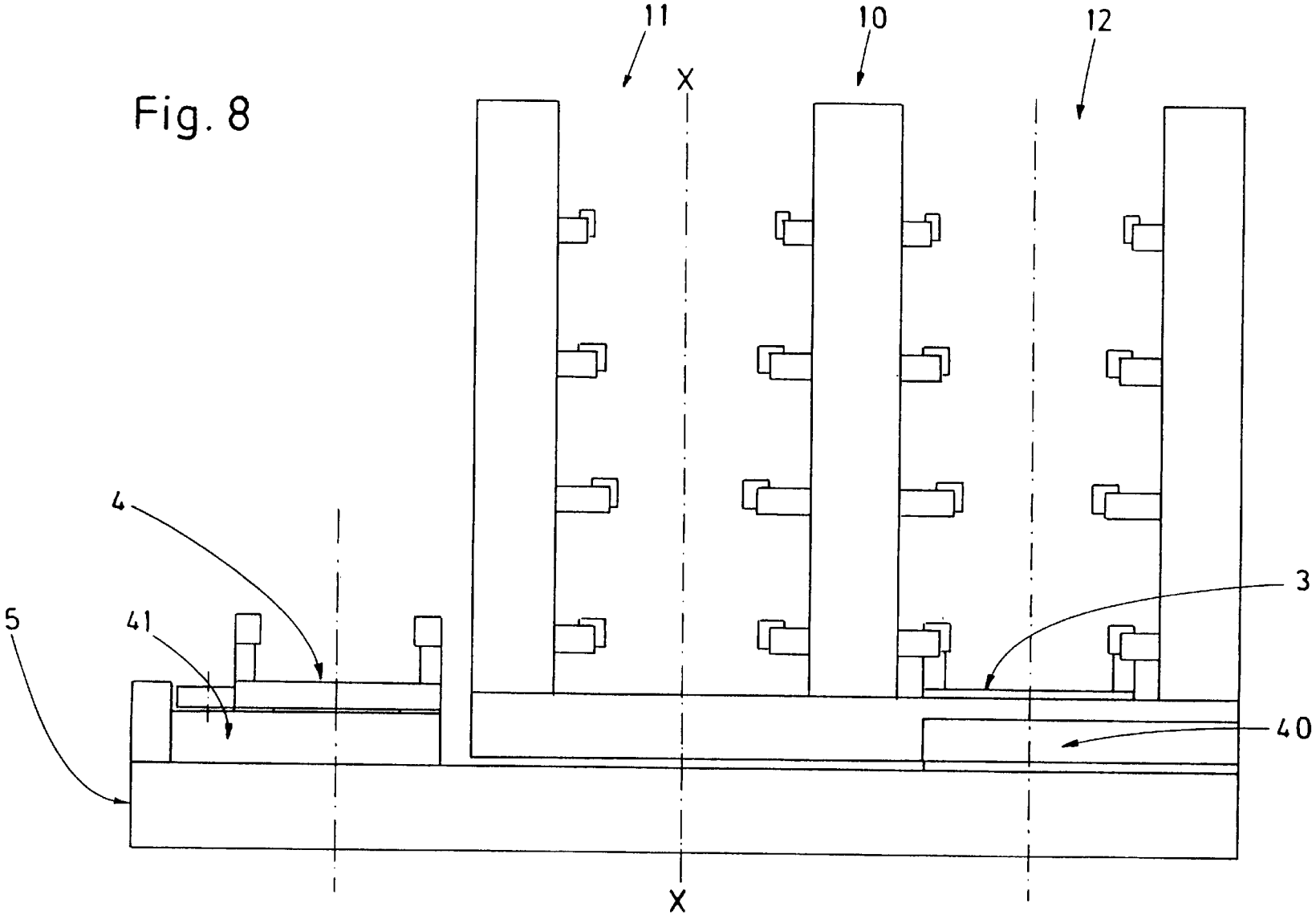

The situation which is then reached is illustrated in FIG. 8, wherein the side-shifter cassette 10 is located with its two retaining components 11 and 12 on the right hand side of the roll change carriage 1 and with the retaining component 11 in the stand middle x—x.

Figure 9:
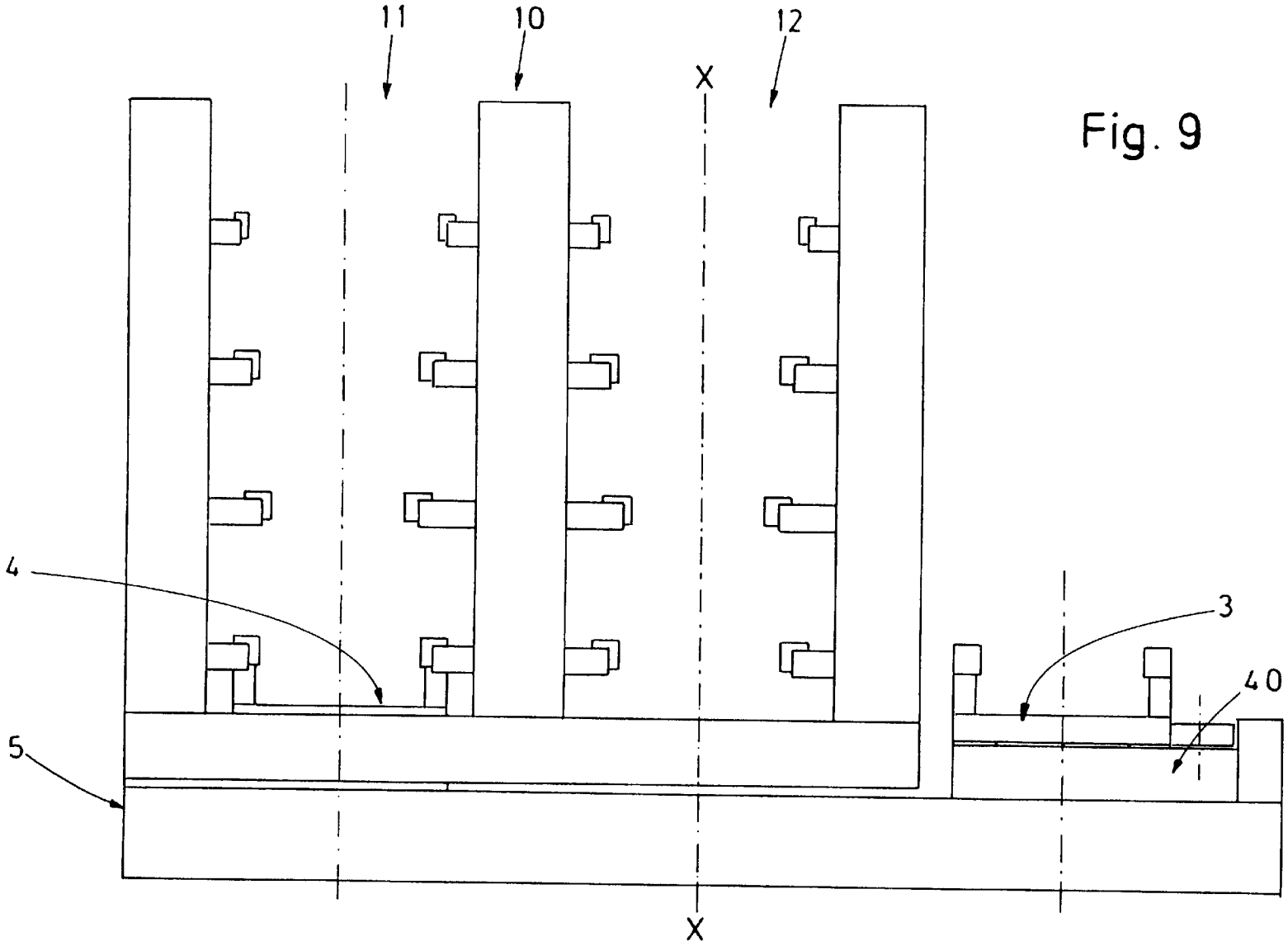

In the next step illustrated in FIG. 9, the side-shifter 10 is moved toward the left with both retaining components 11 and 12, but without changing the position of the two intermediate frames 3 and 4. The retaining component 12 on the right is now available to receive new rolls with the set of rolls 20, 21 and the upper intermediate roll 22 which, due to the configuration of the roll change carriage and its retaining components 11 and 12 in relation to the guide surfaces 24–27 as described above, can be moved in without problems by means of the crane from the top. Since, in this position, the intermediate frame 3 is free on the right next to the retaining component 12, a new lower intermediate roll 23 can also be placed without problems on this intermediate frame 3 by means of the crane. It should be mentioned in this connection, when the intermediate frames 3 and 4 are located laterally next to the side-shifter cassette 10, the intermediate frames 3 and 4 rest on an auxiliary frame 40 or 41, respectively.

Figure 10:
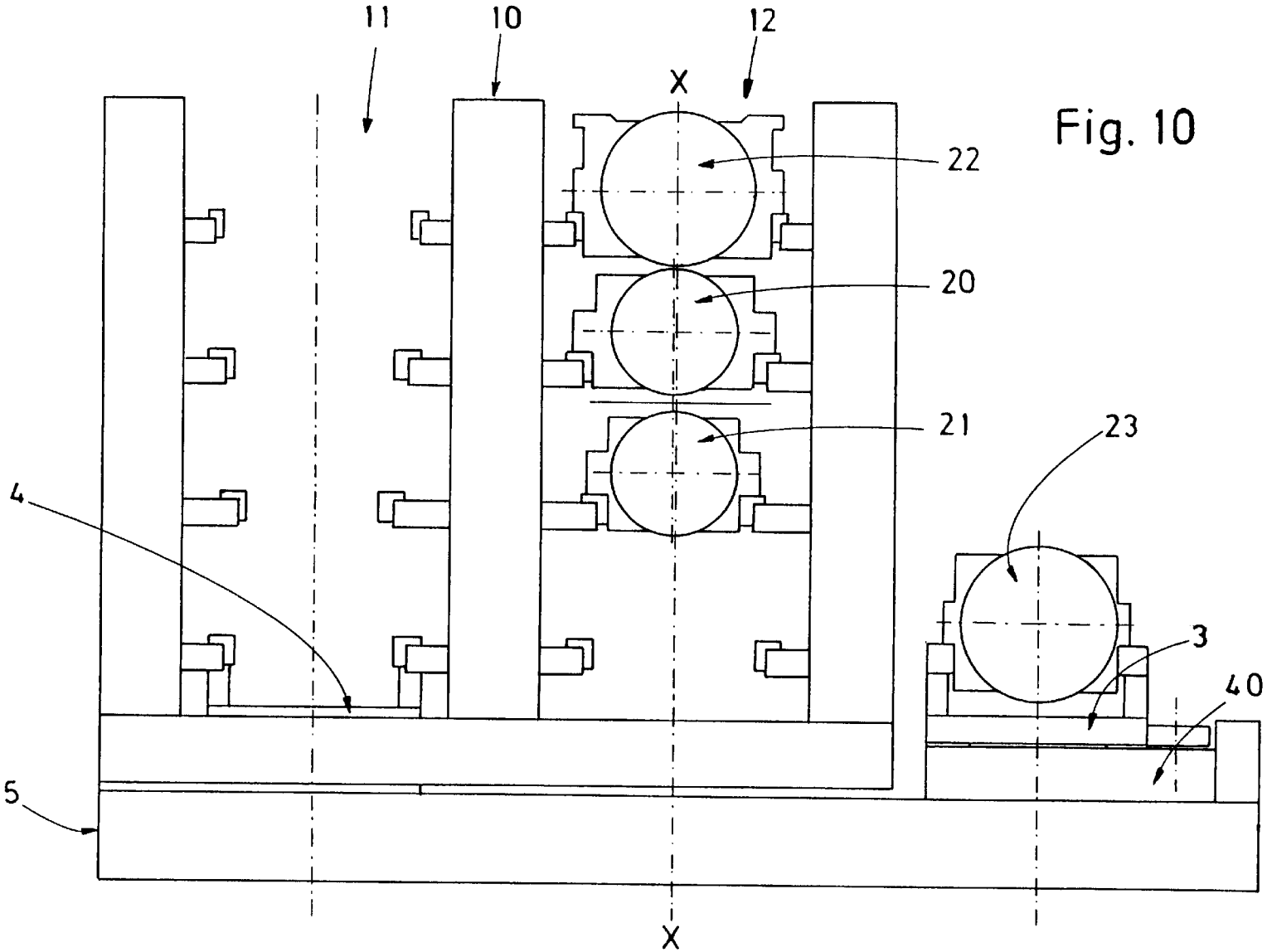

FIG. 10 shows the situation after the retaining component 12 has been loaded with new rolls 20, 21 and 22 and the intermediate frame 3 has been loaded with a new lower intermediate roll 23.

Figure 11:
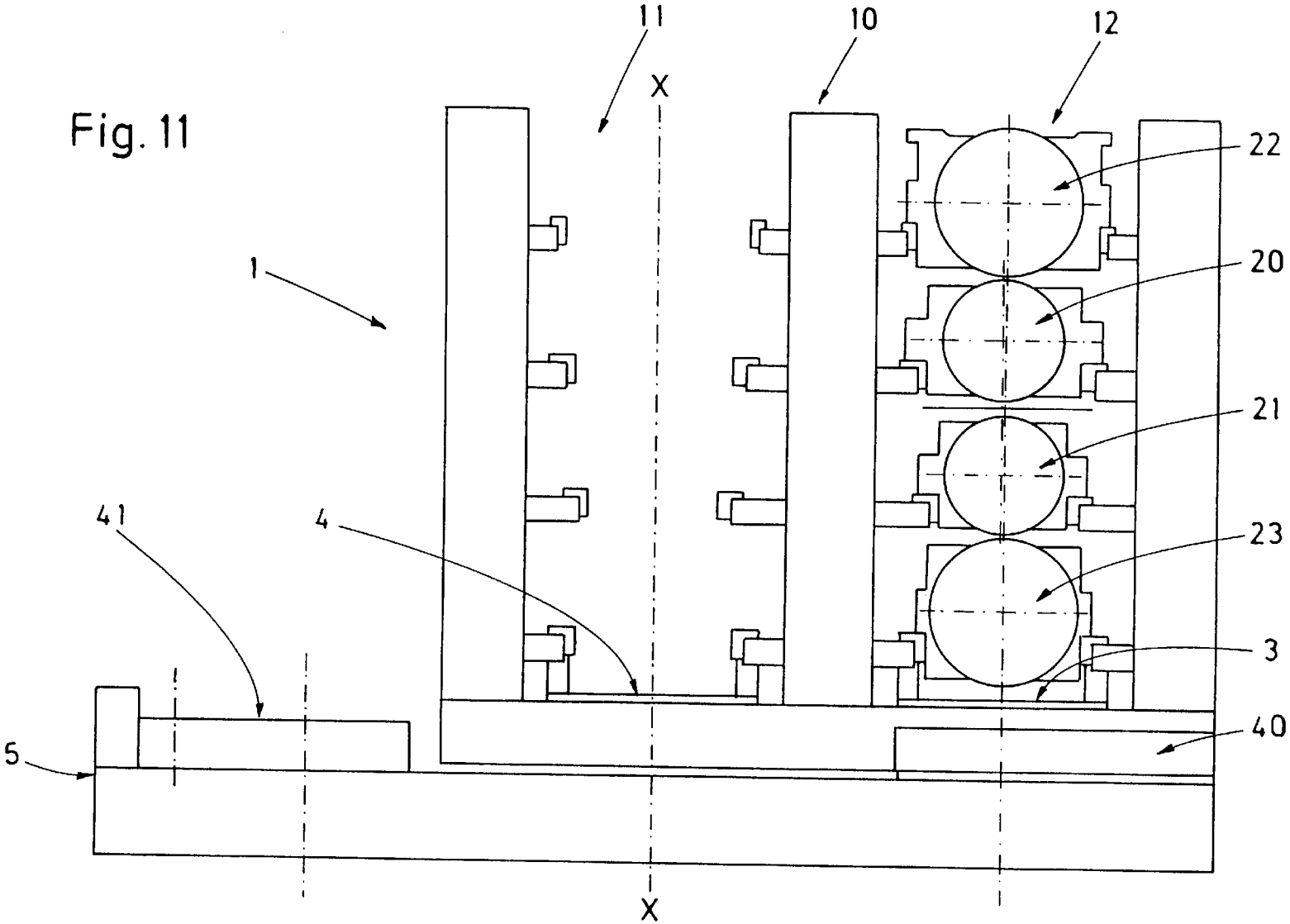

In the last work step illustrated in FIG. 11, the roll change carriage 1 is moved on the undercarriage 5 toward the right, so that the retaining component 11 which is still empty has been positioned in the middle x—x of the stand.

The cycle has now been concluded and can be repeated, wherein the roll change carriage 1 with the then empty retaining component 11 is located in the plane of the stand middle x—x, so that, in accordance with FIGS. 3 and 4, the old rolls 20'–23', can be pulled b, means of the tong truck 2 into the retaining component 11 which has been empty until then.

Figure 12:
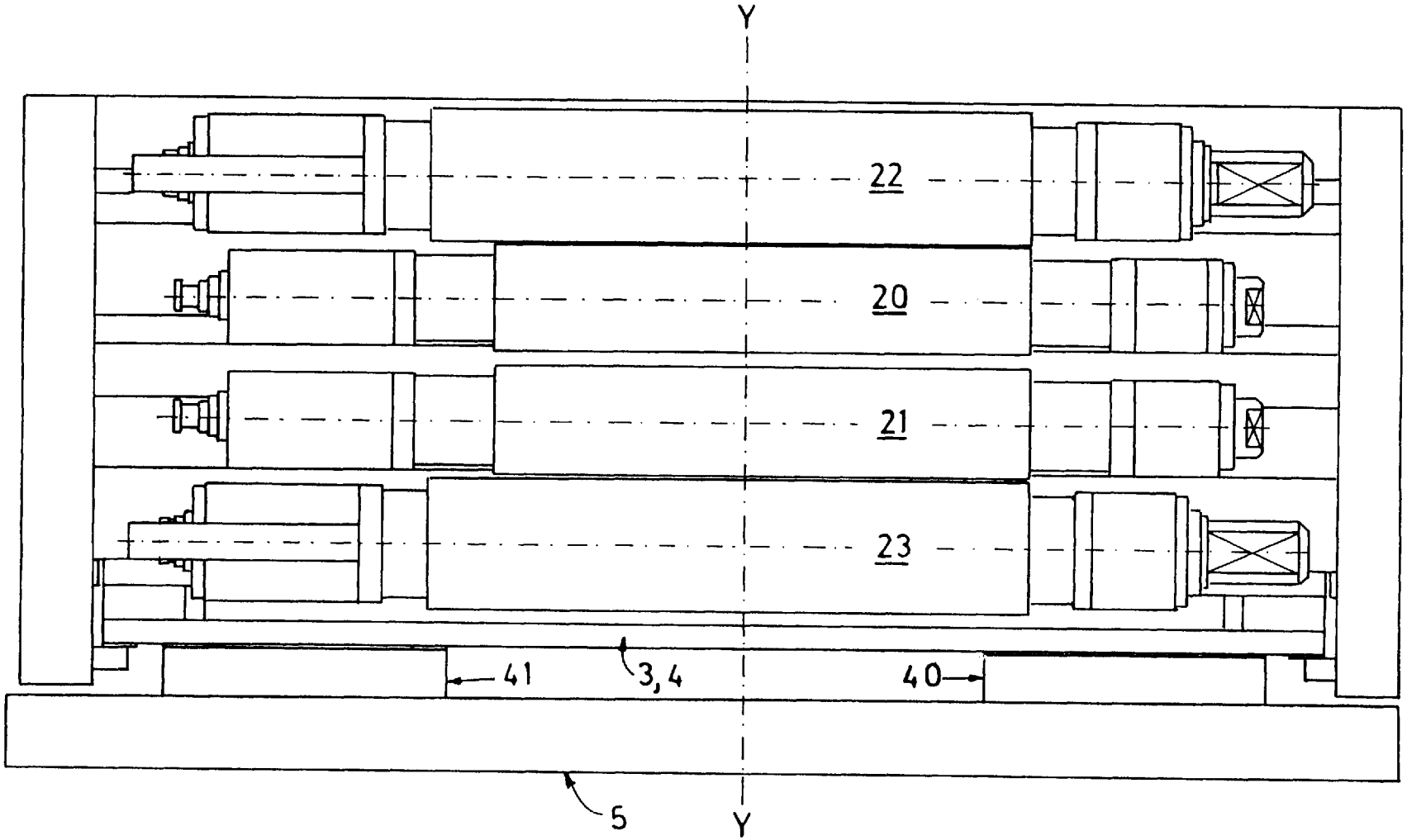
FIG. 12 is a side view of the roll change carriage with side-shifter.

FIG. 12 shows in a side view the position of the rolls 20–23. It is apparent from FIG. 12 that the intermediate frames 3, 4 for the respective intermediate rolls 23 and 23' are received on the auxiliary, frames 40 and 41, respectively, and can be slid or moved with the auxiliary frames in the same horizontal plane.

The device according to the present invention is uncomplicated and meets the object described above in an optimum manner.

While specific embodiments of the invention have been shown and described in detail to illustrate the inventive principles, it will be understood that the invention may be embodied otherwise without departing from such principles.

We claim:

1. A device for effecting rapid roll changes in a six-high roll stand having rolls and chocks for the rolls, the device comprising a roll change carriage with means for moving the carriage relative to the roll stand parallel to and transversely of a rolling direction, and two retaining components for each of a pair of work rolls and a pair of intermediate rolls, wherein the retaining components are arranged next to each other and form a side-shifter cassette, wherein the retaining components have guide surfaces for the chocks of the rolls, and wherein the roll change carriage has in a common rolling plane a device for pushing the rolls in and out, and wherein each retaining component has for receiving a lower intermediate roll with the chocks thereof an intermediate frame with means for moving the intermediate frame into and out of the side-shifter cassette.

2. The device according to claim 1, wherein the roll change carriage comprises an undercarriage for moving the roll change carriage transversely of the rolling direction on rails placed on the ground, wherein the undercarriage has mounted thereon rails extending in the rolling direction, and wherein the rails extending in the rolling direction support the side-shifter cassette which is configured to be moveable independently of the under carriage.

3. The device according to claim 1, wherein the side-shifter cassette comprises a tong truck forming the means for moving the rolls into and out of the roll stand or to and from a roll shop, further comprising a rack drive for moving the tong truck through a retaining component each of the side-shifter cassette.

4. The device according to claim 3, further comprising first locking means for locking the roll change carriage to the roll stand, second locking means for locking the roll change carriage to tong manipulators for upper and lower intermediate rolls, third locking means for locking each intermediate frame independently to the undercarriage, and fourth locking means for socking both intermediate frames to the side-shifter cassette.

5. The device according to claim 2, wherein the undercarriage comprises auxiliary frames for receiving the intermediate frames next to the side-shifter cassette.

6. The device according to claim 4, wherein the tong truck has at an end face thereof connecting elements for a docking system, further comprising counter-connecting elements provided in a work shop, wherein the connecting elements and the counter-connecting elements are configured to supply hydraulic energy from the work shop to the tong manipulators of the tong truck.

7. The device according to claim 3, wherein the tong truck comprises two independent operational units for separately moving the work rolls and intermediate rolls in and out.

8. The device according to claim 4, wherein the locking means are hydraulically operated locking means.

9. A method of carrying out a cycle for a rapid roll change in a six-high roll stand using a device including a roll change carriage with means for moving the carriage relative to the roll stand parallel to and conversely of a rolling direction, and two retaining components for a pair of work rolls and a pair of intermediate rolls, wherein the retaining components are arranged next to each other and form a side-shifter cassette, wherein the retaining components have guide surfaces for chocks of the rolls, and wherein the roll change carriage has in a common rolling plane a device for pushing the rolls in and out, and wherein each retaining component has for receiving a lower intermediate roll with the chocks thereof an intermediate frame with means for moving the intermediate frame into and out of the side-shifter cassette, the method comprising a) preparing the stand for the roll change;

b) moving the roll change carriage laterally next to the stand with a first empty retaining component of the side-shifter in the position of the middle plane of the stand, and moving a second retaining component filled with new rolls into a laterally offset position;

c) moving the tong truck through the empty retaining component and grasping as well as pulling the old work rolls and/or intermediate rolls to be exchanged out of the stand into the retaining component;

d) moving the tong truck back out of the side-shifter;

e) moving the side-shifter in the rolling direction with a set of new work rolls and/or intermediate rolls into a position in the middle plane of the stand;

f) pushing the new rolls into the stand by means of the tong truck;

g) moving the tong truck back out of the side-shifter;

h) uncoupling the intermediate frame with the old intermediate roll and locking the intermediate frame to the undercarriage, moving the side-shifter to the side with the rest of the rolls into the position in the middle of the stand;

i) moving the upper intermediate roll, the upper work roll, the lower work roll out of the side-shifter, and the lower intermediate roll out of the intermediate frame by means of a crane;

j) moving the side-shifter without the undercarriage locked to the intermediate frame but with the second retaining component into the stand middle position and loading the side-shifter with the lower work roll, the upper work roll and the upper intermediate roll, and loading the corresponding intermediate frame with the lower intermediate roll; and k) moving the side-shifter over the full intermediate frame with the empty detaining component into the position of the middle plane of the stand for preparing for repeating the cycle according to work steps a) through g).

* * * * *